US007978148B2

(12) United States Patent
O'Neill et al.

(10) Patent No.: US 7,978,148 B2
(45) Date of Patent: Jul. 12, 2011

(54) QUADRIFILAR HELICAL ANTENNA

(76) Inventors: Gregory A. O'Neill, Rockledge, FL (US); Murray Fugate, Coral Springs, FL (US); Young-Min Jo, Viera, FL (US); John C. Farrar, Indialantic, FL (US); Myung Sung Lee, Seoul (KR); Se-Hyun Oh, Seoul (KR); Joo Mun Lee, Kyunggi-Do (KR); Jin Hee Yoon, Seoul (KR); Sang Ok Choi, Seoul (KR); Eun Seok Han, Seoul (KR)

( * ) Notice: Subject to any disclaimer, the term of this patent is extended or adjusted under 35 U.S.C. 154(b) by 180 days.

(21) Appl. No.: 12/367,528

(22) Filed: Feb. 8, 2009

(65) Prior Publication Data

US 2009/0201215 A1 Aug. 13, 2009

Related U.S. Application Data

(60) Continuation of application No. 11/879,208, filed on Jul. 16, 2007, now Pat. No. 7,489,281, which is a division of application No. 10/998,301, filed on Nov. 26, 2004, now Pat. No. 7,245,268.

(60) Provisional application No. 60/592,011, filed on Jul. 28, 2004.

(51) Int. Cl.
*H01Q 1/36* (2006.01)
*H01Q 1/50* (2006.01)

(52) U.S. Cl. ..... 343/895; 343/860; 343/893

(58) Field of Classification Search ..... None
See application file for complete search history.

(56) References Cited

U.S. PATENT DOCUMENTS

| | | | | |
|---|---|---|---|---|
| 5,828,348 | A * | 10/1998 | Tassoudji et al. | 343/895 |
| 5,963,180 | A * | 10/1999 | Leisten | 343/895 |
| 6,229,498 | B1 * | 5/2001 | Matsuyoshi et al. | 343/895 |
| 6,229,499 | B1 * | 5/2001 | Licul et al. | 343/895 |
| 6,384,798 | B1 * | 5/2002 | Barta et al. | 343/895 |
| 6,424,316 | B1 * | 7/2002 | Leisten | 343/895 |
| 7,176,576 | B2 * | 2/2007 | Chopra et al. | 257/762 |
| 7,245,268 | B2 * | 7/2007 | O'Neill et al. | 343/895 |
| 7,391,386 | B2 * | 6/2008 | Sawaya et al. | 343/833 |
| 7,489,281 | B2 * | 2/2009 | O'Neill et al. | 343/822 |
| 2003/0063040 | A1 * | 4/2003 | Miyata et al. | 343/895 |
| 2004/0090389 | A1 * | 5/2004 | Jo et al. | 343/797 |

FOREIGN PATENT DOCUMENTS

| | | | |
|---|---|---|---|
| EP | 791978 | A2 * | 8/1997 |
| WO | 2006/011723 | A1 * | 2/2006 |

* cited by examiner

*Primary Examiner* — Trinh V Dinh
(74) *Attorney, Agent, or Firm* — John L. DeAngelis; Beusse Wolter Sanks Mora & Maire, P.A.

(57) ABSTRACT

A quadrifilar helical antenna comprising two pairs of filars having unequal lengths and phase quadrature signals propagating thereon. A conductive H-shaped impedance matching element matches a source impedance to an antenna impedance. The impedance matching element having a feed terminal at the center thereof from which current is supplied to the two filars of each filar pair disposed about an edge of the impedance matching element and symmetric with respect to a center of the impedance matching element. The impedance matching element further comprises a reactive element for matching the antenna and source impedances.

2 Claims, 6 Drawing Sheets

QUADRIFILAR HELICAL ANTENNA

The present application is a continuation of the patent application filed on Jul. 16, 2007 and assigned application Ser. No. 11/879,208 (now U.S. Pat. No. 7,489,281), which is a divisional of the utility application filed on Nov. 26, 2004 and assigned application Ser. No. 10/998,301 (now U.S. Pat. No. 7,245,268), which further claims benefit under Section 119(e) of the provisional application filed on Jul. 28, 2004 and assigned application No. 60/592,011.

FIELD OF THE INVENTION

The present invention relates to an antenna for use in a satellite communications link, and in particular to a quadrifilar helical antenna (QHA) for use in a satellite communications link.

BACKGROUND OF THE INVENTION

A helical antenna comprises one or more elongated conductive elements wound in the form of a screw thread to form a helix. The geometrical helical configuration includes electrically conducting elements of length L arranged at a pitch angle P about a cylinder of diameter D. The pitch angle is defined as an angle formed by a line tangent to the helical conductor and a plane perpendicular to a helical axis. Antenna operating characteristics are determined by the helix geometrical attributes, the number and interconnections between the conductive elements and the feed arrangement. When operating in an end fire or forward radiating axial mode the radiation pattern comprises a single major pattern lobe. The pitch angle determines the position of maximum intensity within the lobe. Low pitch angle helical antennas tend to have the maximum intensity region along the axis; for higher pitch angles the maximum intensity region is off-axis.

Quadrifilar helical antennas (QHA) are used for communication and navigation receivers operating in the UHF, L and S frequency bands. A resonant QHA with limited bandwidth is also used for receiving GPS signals. The QHA has a relatively small size, excellent circular polarization coverage and a low axial ratio over most of the upper hemisphere field of view. Since the QHA is a resonant antenna, its dimensions are typically selected to provide optimal performance for a narrow frequency band. C. C. Kilgus first described the QHA in "Resonant Quadrifilar Helix," IEEE Transactions on Antennas and Propagation, Vol. AP-17, May 1969, pp. 349-351.

One prior art quadrifilar helical antenna comprises four equal length filars mounted on a helix having a diameter of about 30 mm for operation at about 1575 MHz. Given these geometrical features, the antenna presents a driving point impedance of about 50 ohms, which is suitable for matching to a common 50 ohm characteristic impedance coaxial cable. The four filars of the QHA are fed in phase quadrature, i.e., a 90 degrees phase relationship between adjacent filars. There are at least two known prior art techniques for quadrature feeding of the four equal-length QHA mars. One such quadrature matching structure employs a lumped or distributed branch line hybrid coupler (BLHC) and a terminating load, together with two lumped or distributed baluns. Another technique that offers a somewhat broader bandwidth, uses three branch line hybrid couplers (a first input BLHC receiving the input signal and providing an output signal to two parallel BLHC'S) each operative with a terminating load. A quarter wave phase shifter provides a 90 degrees phase shift between the first BLHC and one of the parallel-connected BLHC'S.

It is known that such quadrature matching techniques, such as hybrid couplers and baluns, disadvantageously increase the size of the printed circuit board on which the antenna is mounted. The couplers and baluns also increase the antenna cost, and each additional component operative with the antenna imposes losses and bandwidth limitations.

It is further known in the prior art to construct a QHA comprising a first and a second filar having unequal lengths, i.e., a long and a short filar. Each filar further comprising a first and a second conductive element. The first filar comprises a coaxial cable having a center conductor connected to an antenna feed terminal at a bottom end of the QHA and a shield connected to an antenna ground terminal. The second filar comprises a conductive wire. At a top end of the QHA, the coaxial cable shield is connected to the first element of the second filar and the center conductor is connected to the second element of the second filar. At the bottom end, the coaxial cable center conductor (comprising the first filar) is connected to the shield and the first and second elements of the second filar are connected together.

Typically, the QHA is a self-sufficient radiating structure operated without a ground plane or counterpoise. However, when the QHA is installed in close proximity to a radio transceiver handset, the handset structure can induce electromagnetic wave reflections that influence the QHA's radiation pattern and impedance, much like a ground plane. For example, if the QHA emits a right-hand circularly polarized signal, upon reflection from a conducting surface, the signal is transformed to a left-hand circularly polarized signal. Obviously, such effects negatively influence the antenna's performance, and can be particularly troublesome if the communications system employs dual signal polarizations.

BRIEF DESCRIPTION OF THE DRAWINGS

The foregoing and other features of the present invention will be apparent from the following more particular description of the invention as illustrated in the accompanying drawings, in which like reference characters refer to the same parts throughout the different figures. The drawings are not necessarily to scale, emphasis instead being placed upon illustrating the principles of the invention.

SUMMARY OF THE INVENTION

Figure 1:
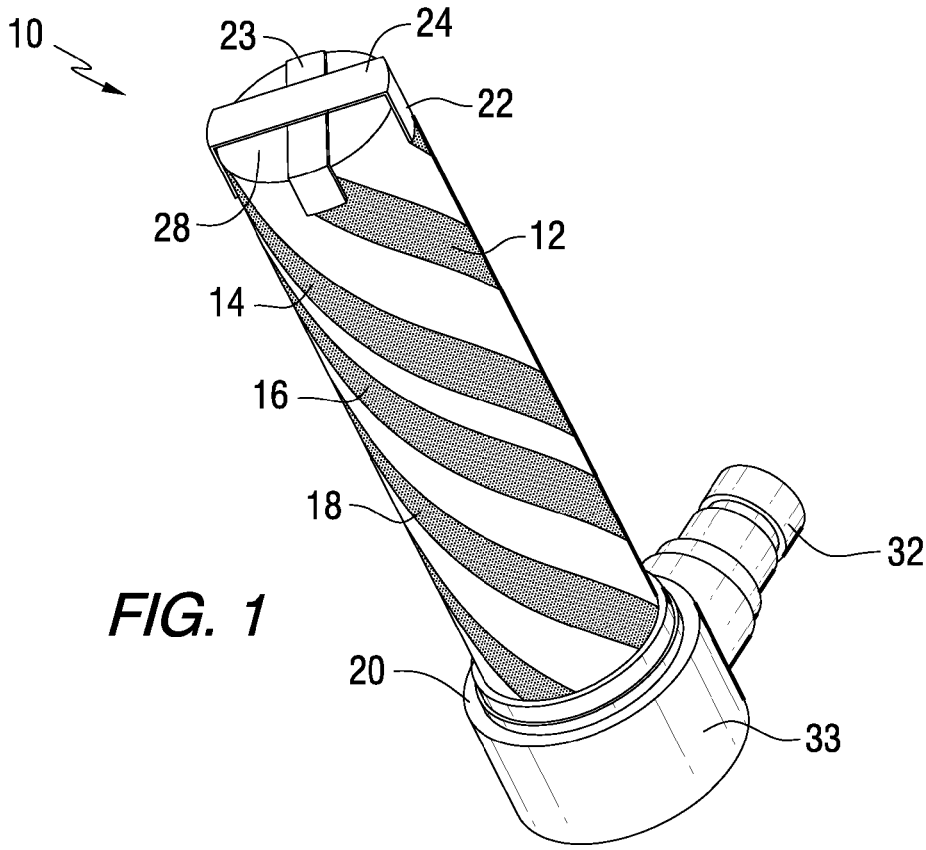
FIGS. 1 and 2 illustrate different views of a QHA according to the teachings of the present invention.

In one embodiment, the present invention comprises a quadrifilar helical antenna, further comprising a first pair of serially connected helical filars having a first length and a first and a second end and a second pair of serially connected helical filars having a second length different from the first length and having a third and a fourth end. The antenna further comprises an impedance matching element conductively connected to the first, second, third and fourth ends for matching an antenna load impedance to a source impedance.

The invention further comprises a method for designing a quadrifilar helical antenna in a shape of a cylinder, having at least one of a predetermined height and diameter, comprising: determining a length of a first filar loop to present an impedance having a real component and an inductive component; determining a length of a second filar loop to present an impedance having a real component substantially equal to the real component of the first filar loop and having a capacitive component, wherein a magnitude of the inductive component is substantially equal to a magnitude of the capacitive component; and determining an impedance matching element connected to the first and the second filar loops for matching an antenna impedance to a source impedance.

DETAILED DESCRIPTION OF THE INVENTION

Before describing in detail the particular antenna apparatus and a method for making the antenna according to the present invention, it should be observed that the present invention resides in a novel and non-obvious combination of hardware elements and process steps. Accordingly, these elements have been represented by conventional elements in the drawings and specification, wherein elements and method steps conventionally known in the art are described in lesser detail, and elements and steps pertinent to understanding the invention are described in greater detail.

This invention relates to an antenna responsive to a signal source supplying quadrature related currents to each of four filars, comprising a short pair of filars and a long pair of filars. The antenna further employs a simple, low cost, low loss matching element that takes advantage of the circularly polarized gain provided by the antenna filars. In one embodiment the antenna provides advantageous gain in a relatively small physical package that is near optimum in terms of gain and size when compared to other known antennas. In one application, the antenna offers desired performance features in an earth-based communications handset for communicating with a satellite.

In one embodiment, a QHA of the present invention operates over a frequency band from 2630 to 2655 MHz (i.e., a bandwidth of approximately 1%). The radiation pattern favors right hand circular polarization (RHCP). Within a solid angle of about 45 degrees from the zenith the gain is about 2.5 dBrhcpi, that is, more than 2.5 decibels relative to a right hand circularly polarized isotropic antenna. The gain at the zenith approaches 4.0 dBrhcpi. The standing wave ratio (SWR) is about 1.5:1 over the frequency range of 2630 to 2655 MHz. The QHA of the present invention, or derivative embodiments thereof, may satisfy requirements for use with an earth-based communications device for sending and/or receiving signals from a satellite, such as a GPS satellite, Korea's Satellite DMB system and satellite commercial radio systems operated by XM Radio and Sirius.

Figure 2:
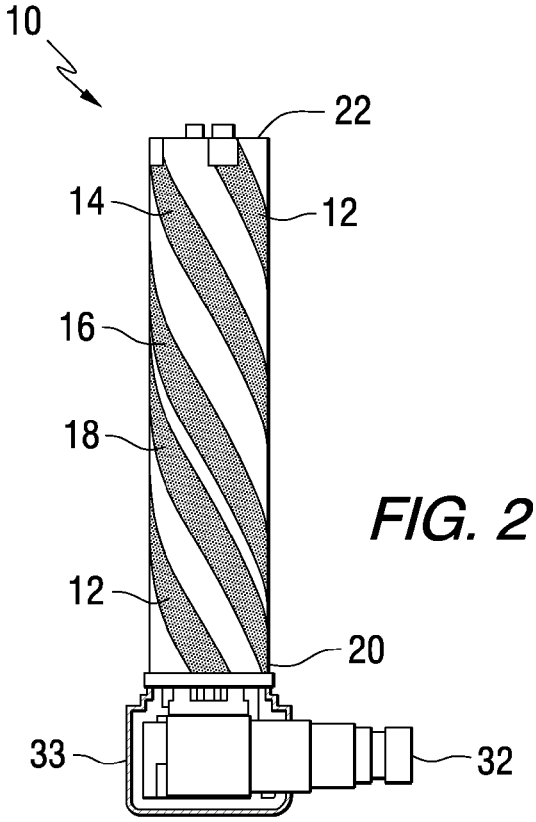

FIGS. 1 and 2 illustrate a QHA 10 according to the teachings of the present invention, comprising filar windings 12, 14, 16 and 18 extending from a bottom region 20 to a top region 22 of the QHA 10, which is generally in the shape of a cylinder. FIG. 1 illustrates a QHA wherein the oppositely disposed filars 12 and 16 are conductively connected by a conductive bridge 23, and the filars 14 and 18 are conductively connected by a conductive bridge 24. Signals propagating on the filars 12/16 are in phase quadrature with signals propagating on the filars 14/18, to produce the desired circular signal polarization. In a preferred embodiment, the filars 12, 14, 16 and 18 each comprises a conductive element, such as a wire having a circular or rectangular cross-section or a conductive line or trace on a dielectric substrate.

As is known in the art, conductive bridges are employed with QHA'S having a filar length equal to an even number of quarter wavelengths at the operating frequency, but are not typically used when the filar lengths comprise an odd number of quarter wavelengths. In one embodiment, each conductive bridge 23 and 24 (also referred to as a crossbar) comprises a conductive tape strip.

In the embodiment of FIGS. 1 and 2, the four filar conductors 12, 14, 16 and 18 extend in a substantially uniform helical pattern from the bottom region 20 to the top region 22 of an imaginary cylinder. In another embodiment, not illustrated, one or more of the filars is disposed about the cylinder in a zigzag or serpentine pattern from the bottom region 20 to the top region 22.

In embodiments implementing the structure of FIGS. 1 and 2, and for use in the band from 2630 to 2655 MHz, the cylinder diameter ranges from about 8 mm to about 10 mm. An antenna constructed according to the present invention provides a peak gain in excess of about 3.5 dBrhcpi. The maximum gain at the zenith occurs with a filar pitch angle of about 45 degrees. Increased gain within a 45 degrees solid angle from the zenith can be achieved by using a pitch angle of about 60 degrees. In another embodiment, the pitch angle is about 75 degrees, but it has been observed that the 60 degree pitch angle provides adequate gain within the 45 degrees solid angle for an intended application. Generally, lowing the pitch angle increases the gain at the zenith. An antenna constructed with a 60 degree pitch angle exhibits a shorter axial height than one with a pitch angle of 75 degrees, which may also be advantageous for some applications. Higher pitch angles tend to produce a beam peak at lower elevation angles while maintaining the peak for all azimuth angles. Also, use of a higher pitch angle tends to broaden the bandwidth and lower the SWR. An antenna constructed with a pitch angle of about 45 degrees has a narrower bandwidth and a higher SWR bandwidth than a QHA with a 60 degrees pitch angle. The balanced and essentially resonant conditions to achieve satisfactory circular polarization generally suggest narrow band antennas.

A nominal length of each filar 12, 14, 16 and 18 is about 25 mm for an approximately quarter-wavelength antenna structure operative at about 2642.5 MHz. The nominal filar length is about 46 mm for a half-wavelength QHA. Based on these filar lengths and a pitch angle of about 60 degrees, the antenna axial height is about 18 mm for the quarter-wavelength QHA and about 39 mm for the half-wavelength QHA. In one embodiment of the quarter-wavelength QHA, the antenna comprises a diameter of about 16 mm. In a one half-wavelength embodiment, the filar structure diameter is about 8.5 mm. When completely assembled with a radio frequency connector, radome housing and a short cable disposed between the antenna and the connector, the overall dimensions are 68 mm in height and 12 mm diameter.

The half-wavelength QHA radiation pattern exhibits better forward gain and a smaller back lobe in the radiation pattern than the quarter-wavelength QHA. In other embodiments, three-quarter, five-quarter, etc. wavelength QHA'S can be utilized according to the teachings of the present invention. It is known that the higher fractional quarter wavelength embodiments provide a higher gain at the peak of the beam, i.e., a narrower radiation pattern, expanded bandwidth and a higher front hemisphere-to-back hemisphere ratio.

In a preferred embodiment of the present invention, lengths of the QHA filars are modified from the nominal length. That is, the filars 12, 14, 16 and 18 comprise a first pair or loop of long filars (e.g., filars 12 and 16) and a second pair or loop of short filars (e.g., 14 and 18), where long and short are measured with respect to the nominal length related to the antenna's resonant frequency, i.e., a nominal length of about 25 mm for a quarter-wavelength antenna operating at about 2642.5 MHz, including the length of the conductive bridge 23/24 and a segment of the feed structure for matching the antenna impedance to the feed structure impedance, which is described below, such that the total length circumscribes a conductive loop. The length differential between the two filar pairs maintains the phase quadrature relationship for the signals propagating on the four filars.

In a half-wavelength embodiment, the long filars each have a length of about 46 mm and the short filars each have a length of about 44.5 mm, where both lengths include the length of the conductive bridge of each filar pair and a conductive segment of the feed structure (for matching the antenna impedance to the feed structure impedance), which is described below, such that the total length circumscribes a conductive loop.

As can be seen in FIG. 1, each of the conductive bridges 23 and 24 connects oppositely disposed filars, with an air gap 28 therebetween due to the length differential of the filars. The air gap distance thus controls the filar length differential. In another embodiment, the length differential is created by forming filars of unequal lengths, such as by employing different pitch angles for the two filar pairs.

In the quarter-wavelength embodiment of the present invention for operation at about 2642.5 MHz, the long and the short filar lengths are about 23.325 mm and about 21.075 mm, respectively.

Consumer marketing considerations for emerging applications for antennas of this type, such as consumer electronic devices such as a handset as described below, tend to impose the smallest possible size on the antenna developer. The dimensions of certain of the QHA embodiments of the present invention were driven by customer requirements, and it is suggested that these dimensions are very close to the minimum size capable of providing the desired radiation pattern and bandwidth performance. It has been observed that at smaller dimensions the antenna elements tend to self absorb the radiation.

A communications handset is one application for the QHA 10. With reference to FIGS. 1 and 2, a radio frequency connector 32 provides an electrical connection to receiving and/or transmitting elements of the handset. In a transmit mode, a radio frequency signal is supplied to the QHA 10 from transmitting elements within the handset via the connector 32. In a receiving mode, the radio frequency signal received by the QHA 10 is supplied to handset receiving elements via the connector 32. As further described and illustrated below, the QHA 10 further comprises a radome, including a radome base 33 illustrated in FIGS. 1 and 2.

An antenna of the present invention can be configured with an antenna signal feed (such as the signal feed described below) disposed at the top region 22 or the bottom region 20. The QHA 10 exhibits different operating characteristics (including the radiation pattern) depending on whether the antenna is top fed or bottom fed. But in either case, a majority of the energy is radiated in a direction of the zenith.

If the antenna signal feed is disposed in the bottom region 20, the QHA is operative in a forward fire axial mode with the signal feed connected directly to a signal conductor, such as a 50 ohm coaxial cable.

If the antenna signal feed is disposed proximate the top region 22, the QHA operates in a backward fire axial mode. In one embodiment of a backward fire axial mode QHA, a transmission line is connected to a signal feed structure within the top region 22 and extends to the bottom region 20 (and in one embodiment extends below the bottom region 20) where the transmission line is connected to a 50 ohm coaxial cable. The transmission line can operate as a quarter wavelength transmission line transformer to match the antenna impedance presented at the signal feed (also referred to as the driving point impedance) to the 50 ohm characteristic impedance of the coaxial cable. In certain applications the bottom feed structure is preferred as it eliminates the need for the transmission line (or transmission line transformer) extending between the top region 22 and the bottom region 20.

The QHA of the present invention, like all antennas, presents a driving point impedance (at its signal feed terminal) to a transmission line feeding the antenna. For optimum power transfer, it is desired to match the antenna driving point impedance to a characteristic impedance of the transmission line, also referred to as a source or load impedance. An impedance match occurs when the resistive or real component of the antenna and the source impedance are equal, and the reactive or imaginary components are equal in magnitude and opposite in sign. Since a commonly used transmission line has an impedance of 50 ohms, it is desired to construct the QHA of the present invention with a 50 ohm impedance or an impedance that can be conveniently transformed to 50 ohms, for connection to the 50 ohm transmission line.

As described above, use of the QHA for a specific application drives the antenna's operating and physical characteristics. To achieve these characteristics, the QHA presents a relatively narrow diameter cylinder, and the relatively narrow diameter cylinder produces a driving point impedance below 50 ohms, including an inductive component. It has been found that for certain embodiments, the impedance is in a range of about 3 to 15 ohms. Similar inductance values are presented for all quarter-wavelength multiples, e.g., ¼, ½, ¾, 5/4, 7/4, etc. To achieve a 50 ohm antenna driving point impedance requires a cylinder diameter greater than is generally considered acceptable for use with the communications handset.

An impedance matching element 48 (see FIG. 3) matches the antenna driving point impedance to the source impedance, according to the teachings of the present invention. The matching element 48 comprises an "H-shaped" conductive element 50 disposed on a dielectric substrate 52, e.g., the conductive element 50 and the dielectric substrate 52 comprise a printed circuit board having a conductive pattern thereon. The impedance matching element 48 further comprises a signal feed terminal 54 (proximate a center of the substrate 52 orienting the various elements of the QHA symmetrically with respect to the substrate center). The center-fed impedance matching element 48 overcomes the disadvantages of the prior art baluns, providing a matching structure that can be physically integrated with the antenna radiating elements to present an integrated radiating and impedance matching structure for incorporation into a communications device, such as a handset.

In the illustrated embodiment, the QHA 10 is fed from a coaxial cable 55 comprising a center conductor 56 connected to a terminal 57A of a capacitor 57, and further comprising a shield 58. An inductor 59 is connected between the center conductor 56 and the shield 58. In a preferred embodiment, the capacitor 57 has a value of about 1.8 pF and the inductor 59 has a value of about 2.2 nH. The capacitor and inductor value are selected to provide the desired impedance match, when operating in conjunction with the structural features of the feed and the antenna elements that also affect the impedance match. The capacitor 57 and the inductor 59, disposed as shown, form a two-element impedance match between the source impedance (of the coaxial cable 55) and the QHA 10. Thus, the antenna's natural driving point impedance is transformed by the capacitor and the inductor to approximately 50 ohms.

A length of the center conductor 56 should be kept short as in known by those skilled in the art. It is also known in the art that a balun can be connected proximate the signal feed terminal 54 to prevent stray radio frequency fields from generating a current in the shield 58.

A terminal 57B of the capacitor 57 is connected to a conductive element 60 of the impedance matching element 48 via a conductor 70. The conductive element 60 is conductively continuous with conductive pads 61 and 62. The shield 58 of the coaxial cable 55 is connected to conductive pads 72 and 74 via a conductive element 78. In one embodiment, a solder filet conductively connects the shield 58 to the conductive element 78. The filars 12 (long), 14 (short), 16 (long) and 18 (short) are disposed within openings 72A, 74A, 60A and 62A, respectively, as defined in the respective conductive pad and extend vertically from a plane of the impedance matching element 48. A solder filet (see FIG. 11) bridging the conductive pad and its respective filar forms the conductive connection therebetween.

To form the impedance matching element 48, in one embodiment a conductive layer is disposed on the dielectric substrate 52, and the conductive pads 61, 62, 72 and 74 and the conductive element 78 are formed by selective subtractive etching of the conductive layer.

It is noted that the filars 12 and 16 (both long) are oppositely disposed on the helix relative to a center of the substrate 52. Similarly, the filars 14 and 18 (both short) are oppositely disposed relative to the substrate center. Thus the conductive element 60 of the impedance matching structure 48 connects the long filar 18 and the short filar 16. Similarly, the conductive element 78 connects the long filar 12 and the short filar 14. The conductive bridges 23 and 24 connect the filars at their upper end as described above.

The impedance matching element 48 may be disposed at the proximal end, as described, or a distal end of the QHA 10. The physical features of the matching element 48 (including the value of the capacitor and the inductor) may change from those described above when placed at the distal end.

Exemplary current flow in the impedance matching element 48 is indicated by an arrowhead 100 from the shield 58 through the conductive element 78 to the conductive pad 72. Current flow continues through the long filar 12, the conductive bridge 23, and the long filar 16 (see FIG. 1) to the conductive pad 61. An arrowhead 102 depicts current flow from the conductive pad 61 through the conductive element 60 and the capacitor 57 to the center conductor 56.

Similarly, current flow is indicated by an arrowhead 104 from the shield 58, through the conductive element 78 to the conductive pad 74. Current flow continues through the short filar 14, the conductive bridge 24, and the short filar 18 (see FIG. 1) to the conductive pad 62. An arrowhead 106 depicts current flow from the conductive pad 62 to the center conductor 56 via the conductive element 60 and the capacitor 57.

Figure 3:
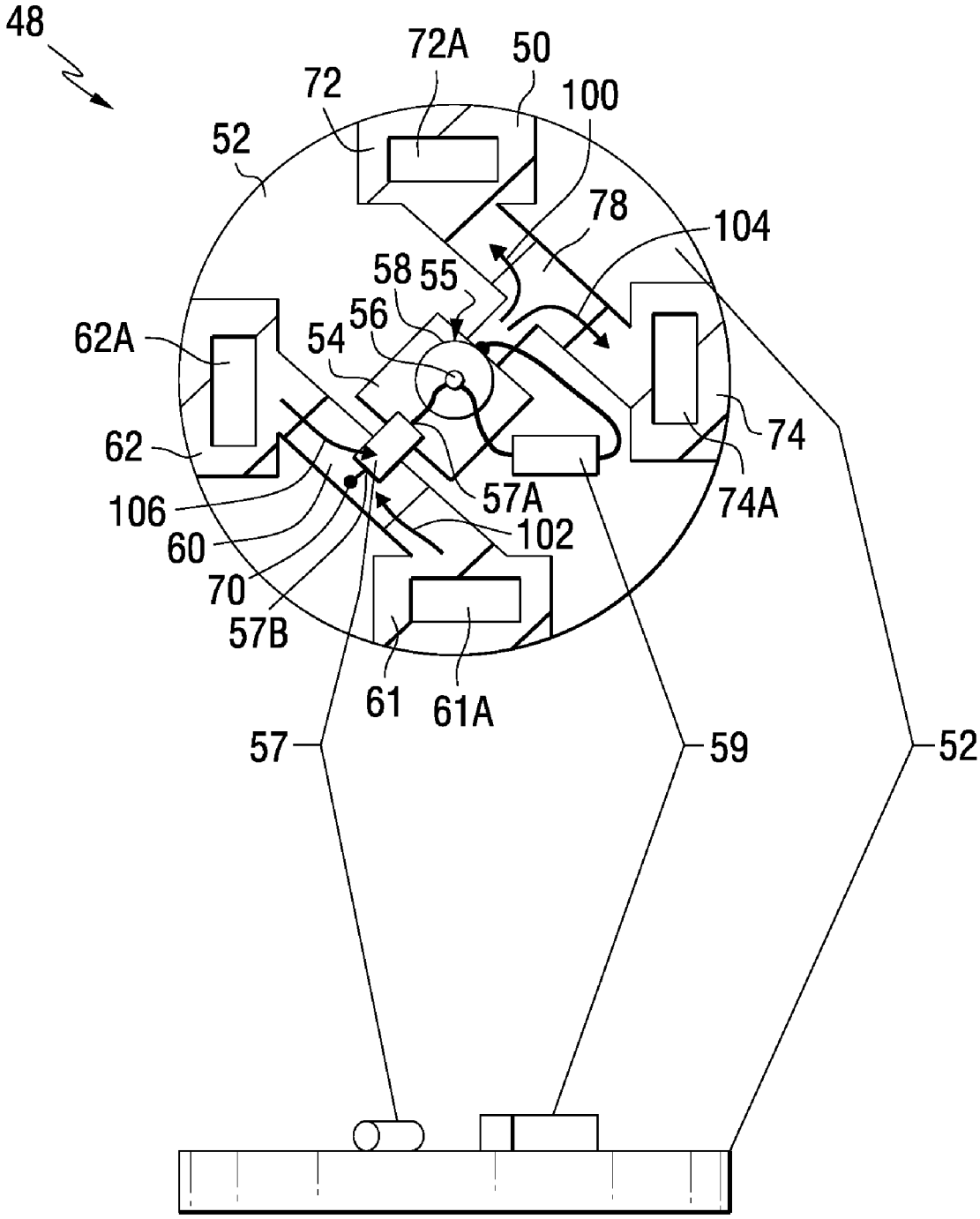
FIG. 3 illustrates an impedance matching element, according to the teachings of the present invention, for use with the QHA of FIGS. 1 and 2.
Figure 5:
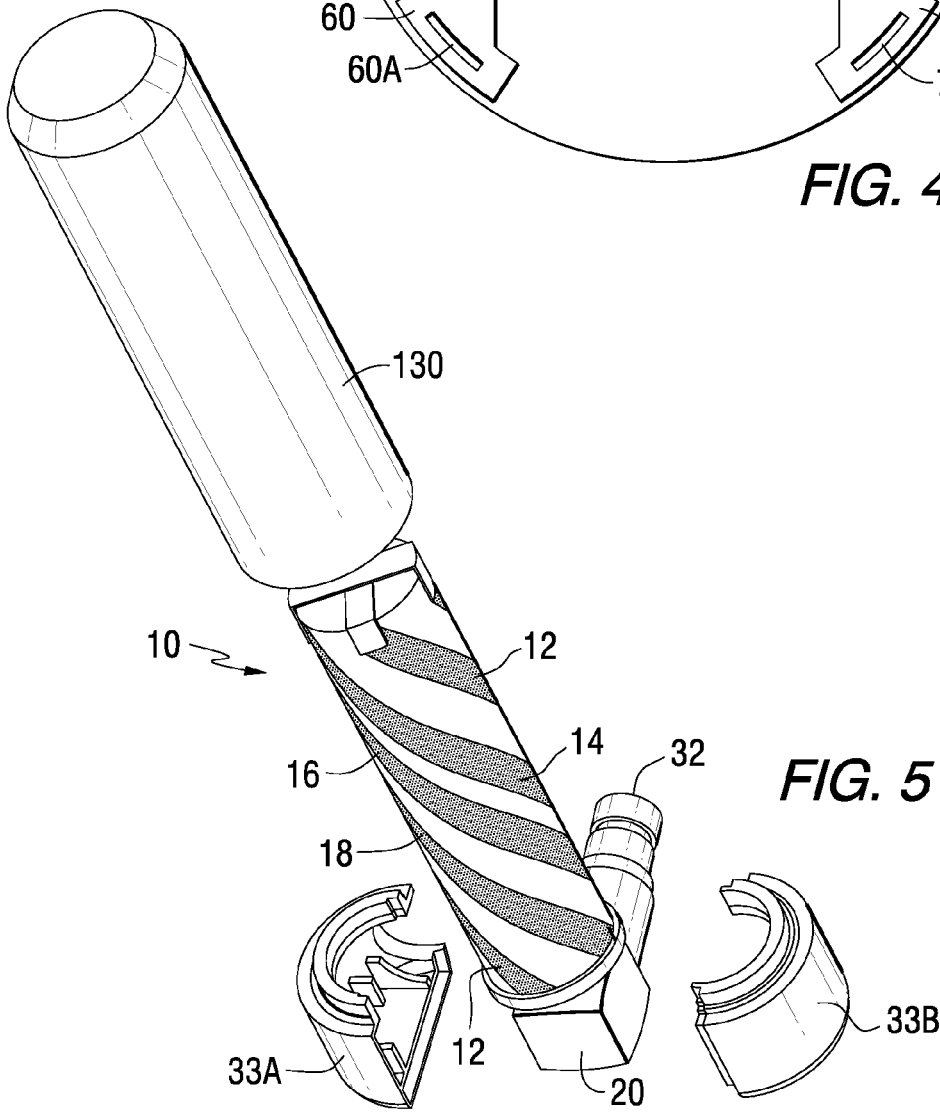
FIG. 5 illustrates a QHA according to the present invention including a radome.

It is known by those skilled in the art that various radio frequency connectors can be used in lieu of the coaxial cable 55 of FIG. 3. For example, as illustrated in the embodiments of FIGS. 1, 2 and 5, the connector 32 is connected to the antenna feed terminal. Terminals of the connector 32 mate with a signal cable, not shown in FIG. 3, that comprises a signal conductor and a ground conductor. The signal conductor is operative in lieu of the center conductor 56 of the coaxial cable 55, and the ground conductor replaces the shield 58. Both are connected to the impedance matching element 48 in a manner similar to connection of the coaxial cable 55 as described above.

As discussed by Kilgus, a QHA may be likened to a dual bifilar helical antenna. Each of the dual bifilars may be considered a transmission line, nearly shorted at one end (e.g., by the conductive bridges 23 and 24 of FIG. 1) and nearly open-circuited at the open end (e.g., at the connection between the filars and the feed structure). By judiciously adjusting a length of each bifilar pair, such that the filars in each pair have relatively small length differential with the filars of one pair longer than the filars of the other pair, the quadrature relationship for the signals propagating on the filars can be maintained to generate the desired circularly polarized signal. The longer filar pair tends to be inductive and the shorter pair tends to be capacitive. In one embodiment the inductive reactance is approximately equal and opposite to the capacitive reactance and the resistance in each of the shorter and longer filar pairs is approximately equal to the respective inductance or capacitance of the filar pair. These complex conjugate impedances, when viewed from the signal feed terminal 54, satisfy the quadrature relationship and generate the desired circularly polarized signal.

Consider a first filar pair (for example, the long filars 12 and 16) oppositely disposed on the impedance matching element 48 and conductively connected to the conductive pads 72 and 61. The nominal length of the filar pair, including the conductive feed structure and the conductive bridge at the top of the helix, is near an electrical half wavelength (for a half wavelength QHA) at the center of the operational frequency band. According to known transmission line theory, a transmission line slightly longer than a half wavelength has an inductive reactance as well as an equivalent series resistance. A transmission line slightly shorter than a half wavelength (e.g., comprising the filars 14 and 18) has a capacitive reactance and a series equivalent resistance.

As can be determined from known transmission line and related electrical engineering principles, the preferred gain and circular polarization occur when the filars are fed in quadrature, both amplitude and phase quadrature.

The impedance for the first or long bifilar pair, measured at the signal feed terminal 54 in the absence of the second filar pair (i.e., in the absence of the short filars 14 and 18), is adjusted to present an impedance of about $Z_{long}=R+jX=12.5+j12.5$ ohms, by lengthening the filars approximately a couple percent above the nominal length, i.e., above the resonant length for the operational frequency. As is known in the art, other impedance values may be used in lieu of 12.5 ohms, which is considered here for exemplary purposes only. The second filar pair is shorter than the first filar pair and thus capacitive, and can be shortened to present an impedance of about (12.5−j12.5) at the signal feed terminal 54 in the absence of the first filar pair. Filars presenting an impedance according to this relationship (i.e., equal real parts and opposite in sign and equal in magnitude imaginary parts) provide the desired circularly polarized signal.

Thus, according to the teachings of the present invention, a method for obtaining adequate gain at an adequate standing wave ratio suggests adjusting the length of both the long filar pair and the short filar pair, noting where the gain peaks and the standing wave ratio dips while a complex conjugate relationship is created between the first and the second filar pairs. It is known that modern computer-based antenna simulation techniques allow a simulated conjugate match to be utilized. After the computer simulation suggests the nature of the conjugate match, those values are used in a test antenna to verify the desired actions.

Recognizing that the first and the second filar pairs are in an electrical parallel configuration, according to the known superposition theorem the composite impedance at the signal feed terminal 54 is expected to be about 12.5 ohms. However, it has been determined that for a QHA having a helical radius of about 8-10 mm, improved operating characteristics (e.g., front-to-back ratio, standing wave ratio, antenna gain, and radiation pattern) are realized when the composite impedance of the two filar pairs is resistive with an inductive component. This inductance is contributed by the various conductive elements of the impedance matching element 48. The amount of inductance is proportional to the diameter of the QHA and the net equivalent diameter of the conductive elements of the matching element 48.

For an exemplary QHA structure having a diameter of about 8.5 mm and a pitch angle of about 60 degrees, the net reactance is about 1.6 nH (j26) at 2642.5 MHz; the resistance is about 12 ohms, for a impedance (Zdp) of about 12+j26 ohms. Note that the reactive component is about twice the series equivalent resistance. Although the actual driving point impedance depends on the antenna diameter and filar pitch angle, this tendency toward an inductive impedance of about twice the value of the resistive component may provide adequate antenna gain and SWR, while providing an acceptable solution for the quadrature relationship between the filars such that a circularly polarized signal is radiated.

It has also been found that the peak QHA gain tends to occur at a frequency slightly below a frequency where the lowest SWR is observed. Thus according to one embodiment, the QHA sacrifices some gain while achieving a satisfactory SWR. However, computer-based design iterations can be performed to adjust the filar dimensions, such as filar length (both or either of the short filar and the long filar), the filar cross-section, the cylinder radius, the filar pitch angle and the matching component values (i.e., the capacitor 57 and the inductor 59) to achieve a greater peak gain but with a higher SWR. Once these filar dimensions and match component values are determined, an antenna constructed based thereon presents reasonable process tolerances to achieve the desired performance.

Design of a QHA according to the present invention considers the relationship between the various antenna physical parameters and the desired operating characteristics. According to one embodiment as described above, the antenna physical parameters are optimized to present an antenna driving point impedance (i.e., a series equivalent impedance) having a real part less than 50 ohms and a positive reactive part. In various embodiments of the invention the remaining reactive component due to the inductance of the conductive structures in the impedance matching element 48 is proportional to the length of those structures. Generally, the reactive component is about twice the resistive component or is in the range of 20 to 40 ohms reactive. According to investigations performed by the inventors, it appears that the QHA exhibits desired, gain, bandwidth, etc. parameters when this relationship between the real and reactive impedance components is presented.

According to one application, it is desired for the QHA to have a relatively small cylindrical diameter for use with the handset communications device. The antenna characteristic impedance is directly related to the antenna diameter, i.e., a smaller diameter lowers the characteristic impedance. Reducing the diameter also lowers the resonant frequency and reduces the bandwidth. A small diameter QHA with equal length first and second filar pairs tends to present a somewhat wider bandwidth and a somewhat higher peak gain, when compared to an embodiment with unequal length filar pairs. However, an elaborate quadrature feed network, such as the branch line hybrid coupler described above in the Background section, is required to drive a QHA with equal length filars. By contrast, according to the present invention adequate bandwidth and gain can be achieved by utilizing different length filar pairs operating with a quadrature feed network for impedance matching, such as the impedance matching elements 48 (described above in conjunction with FIG. 3) and 110 (described below in conjunction with FIG. 4).

Design of a QHA according to the present invention proceeds as follows. The antenna diameter is typically dictated by the customer, either by the available antenna space in the customer's communications device or by other commercial considerations, such as the desired size for an antenna protruding from a communications handset device. However, it should be recognized that there is a design trade-off between diameter and antenna bandwidth. The filar pitch angle can be found by general analysis using equal length filar antennas, for example. Thus the pitch angle is determined to achieve the desired antenna performance characteristics, especially to achieve the desired radiation pattern.

To determine the filar lengths (which will in turn determine the value for the impedance matching elements (i.e., the capacitor 57 and the inductor 59)) the length of the first (e.g., long) and the second (e.g., short) filar pairs are iteratively adjusted for optimum gain while the driving point impedance is permitted to float. The load impedance is then used to calculate the capacitor and inductor values for transforming the antenna load impedance to the characteristic impedance of the transmission line, such as 50 ohms for the coaxial cable 55 of FIG. 3.

According to another design process, a test antenna is designed using the nominal dimensions of the long bifilar loop and its driving point impedance is measured. The lengths are adjusted to tune the impedance to Zlong=12.5+j12.5, for instance. Separately, a test antenna is designed using the nominal dimensions of the short bifilar loop and its driving point impedance measured. The lengths are adjusted to tune the impedance to Zshort=12.5−j12.5, for instance. A straightforward application of the superposition theorem to the long and short filar impedances yields a Zdp (driving point impedance) of 12.5 ohms. However, as described above, conductive elements of the impedance matching elements 48, for example, contribute a reactive component to the antenna's driving point impedance. Thus, notwithstanding the symmetrical structure of the filars, when the long and the short filars are wound about a common core and the impedance matching element connected thereto, the antenna driving point impedance is inductive and the series resistance is slightly greater than 12.5 ohms. To achieve an adequate radiation pattern, the filars lengths are adjusted to achieve the desired gain, followed by matching the Zdp for an adequate SWR over the desired bandwidth. In other embodiments, the filar lengths can be adapted to achieve higher gain over a narrower bandwidth or a somewhat lower gain over a wider bandwidth by adjusting the difference between the length of the long and the short filar loops, i.e., the length differential.

Although achieving this ratio of resistance to inductive reactance by adjusting the length of the long and the short filar pair is a design objective according to one embodiment of the present invention, the QHA of the present invention is not limited to an antenna that presents an inductive reactance that is about twice the resistance. In other embodiments, for example for an antenna of a different cylindrical diameter and/or a different filar pitch angle, a different relationship between the resistive component and the inductive component may be observed. Also, in another embodiment the composite or driving point impedance may include a capacitive component (i.e., a negative reactance value) instead of an inductive component.

The capacitor 57 and the inductor 59 of the impedance matching structure 48 of FIG. 3 are selected to provide an impedance match between the driving point impedance (e.g., 15+30j) of the QHA and the 50 ohm characteristic impedance of the coaxial cable 55 connected to the antenna signal feed terminal 54. As is known in the art, in another embodiment the lumped inductor and capacitor can be replaced by distributed components for performing the impedance matching function, such as a capacitor formed by interdigital conductive traces on the substrate 52 and an inductor formed by a conductive trace in the form of one or more conductive loops or a linear conductive segment. In a further embodiment, the source characteristic impedance is other than 50 ohms, and thus the capacitor and inductor are selected to match to this impedance.

According to another embodiment, a balanced transmission line, selected from one of the various types known in the art, is used instead of the coaxial cable 55. Each conductor of the balanced transmission line is attached to a conductive pad, with the conductive pads disposed on opposing surfaces of a printed circuit board, such as the substrate 52 of FIG. 3. Each pad is further connected to the signal feed terminal 54 of FIG. 3 using conventional connection techniques.

As is recognized by those skilled in the art, different dimensions for the components of the QHA 10 (e.g., a different diameter, different filar lengths or a different filar pitch angle) can be used in another embodiment. These parameters may change the differential length between the first and the second filar pairs and/or the antenna load impedance, which in turn changes the value of the inductor and/or the capacitor for matching the antenna impedance to the source impedance. In one embodiment, the impedance match may require only a single component (either an inductor or a capacitor). However, as discussed above, to optimize the antenna operating characteristics, it may be preferable for the driving point impedance to include a reactive component.

To achieve optimum bandwidth, gain and quadrature signal distribution (which is required for a circularly polarized signal) it is desired that the long and the short filar pairs have an approximately equivalent diameter (or an equivalent cross-section for filars having a quadrilateral cross-section (i.e., length and width) such as filars comprising a conductive trace on a dielectric substrate). It may be possible, however, to accommodate slightly divergent diameters without dramatically affecting antenna performance. Use of same diameter conductors also simplifies the physical filar structure and maintains antenna symmetry.

In one embodiment, the QHA diameter is about 8.5 mm, and thus the antenna circumference is about 25 mm. It is desired to use as wide a conductor as practical to lower the conductor resistance (i.e., reduce ohmic losses), which correspondingly tends (to a point) to broaden the antenna bandwidth. It is also recognized that the filars must be separated by a sufficient distance to reduce filar-to-filar coupling and dielectric loading. In one embodiment, the filar diameter is determined by dividing the antenna circumference by eight and rounding to a convenient integer value. Thus, a 25 mm circumference yields a filar diameter of about 3 mm. According to an embodiment wherein a filar comprises a flat conductor, a half conductor, half dielectric relationship is used to establish a conductor width. Several embodiments of the antenna according to the present invention have favored the above conductor-to-insulator ratio, although it is recognized that other embodiments may favor other ratios. As is known by those skilled in the art, in performing analyses of such QHA'S, a flat conductor can be represented by a round conductor where a diameter of the round conductor is one-half the flat conductor width.

In one embodiment presented above, the driving point impedance of 15+30j is transformed by the impedance matching element 48 (specifically the capacitor 57 and the inductor 59) to 50 ohms for matching the characteristic impedance of the coaxial cable 55. According to another embodiment, such as a quarter wave version of an antenna constructed according to the teachings of the present invention, a capacitor and/or an inductor transform the driving point impedance of 3+6j to about 12.5 ohms, and a quarter wavelength transformer transforms the 12.5 ohm impedance to 50 ohms. A quarter wavelength transmission line having a 25 ohm characteristic impedance ($Z_0$) transforms the 12.5 ohms impedance to 50 ohms according to the equation, $Z_0$=sqrt [(driving point impedance)*(source impedance)].

Figure 4:
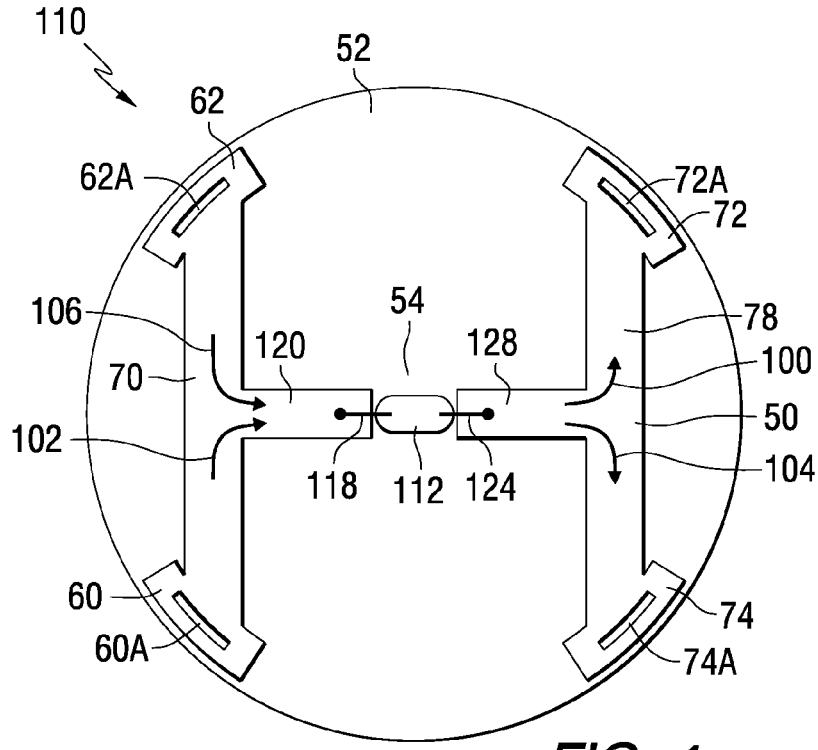
FIG. 4 illustrates another embodiment of an impedance matching element according to the teachings of the present invention.

FIG. 4 illustrates an embodiment of an impedance matching element 110 including a quarter wavelength transmission line transformer 112 connected at the signal feed terminal 54 to match a 12.5 ohms impedance to 50 ohms. The transmission line transformer 112 comprises a conductor 118 connected to an arm 120 of the conductive element 50, and a conductor 124 connected to an arm 128.

As can be appreciated by those skilled in the art, in an embodiment where the antenna's physical parameters create a purely resistive driving point impedance of about 12.5 ohms, the impedance matching element 110 is sufficient to transform the driving point impedance to 50 ohms. The impedance matching element 48 is not required.

A radome is advantageous to avoid antenna damage during user handling of the communications device to which the antenna is connected. Radome material is chosen to exhibit relatively low loss for the antenna's operating frequency range. The dielectric loading effect of the radome can be considered in designing the QHA to achieve operation at the desired resonant frequency and desired bandwidth. A suitable radome 130 for the QHA 10 is illustrated in FIG. 5. As can be seen, the radome 130 mates with the radome base components 33A and 33B that enclose the lower region 20 of the QHA 10.

Figure 6:
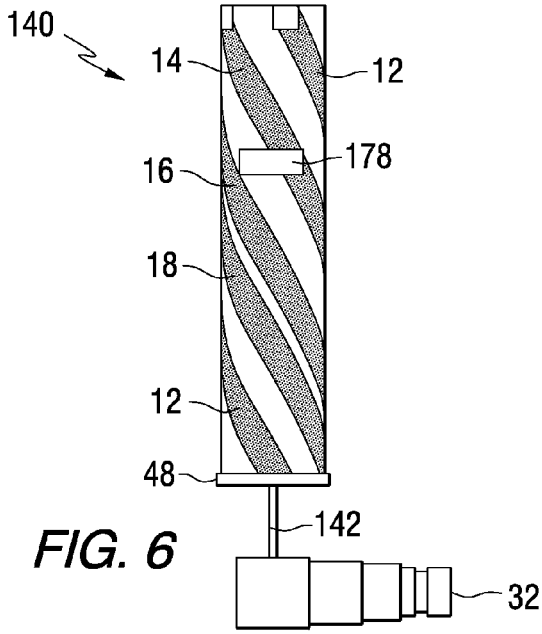
FIG. 6 illustrates another embodiment of a QHA according to the present invention.

Another embodiment according to the teachings of the present invention is represented by a QHA 140 illustrated in FIG. 6, comprising a conductor 142 (typically having a characteristic impedance of 50 ohms) extending between the connector 32 and the impedance matching element 48 within the bottom region 20 of the QHA 140. This embodiment permits physical separation between the connector 32 and the QHA 140 in an application where such separation is advantageous.

Figure 7:
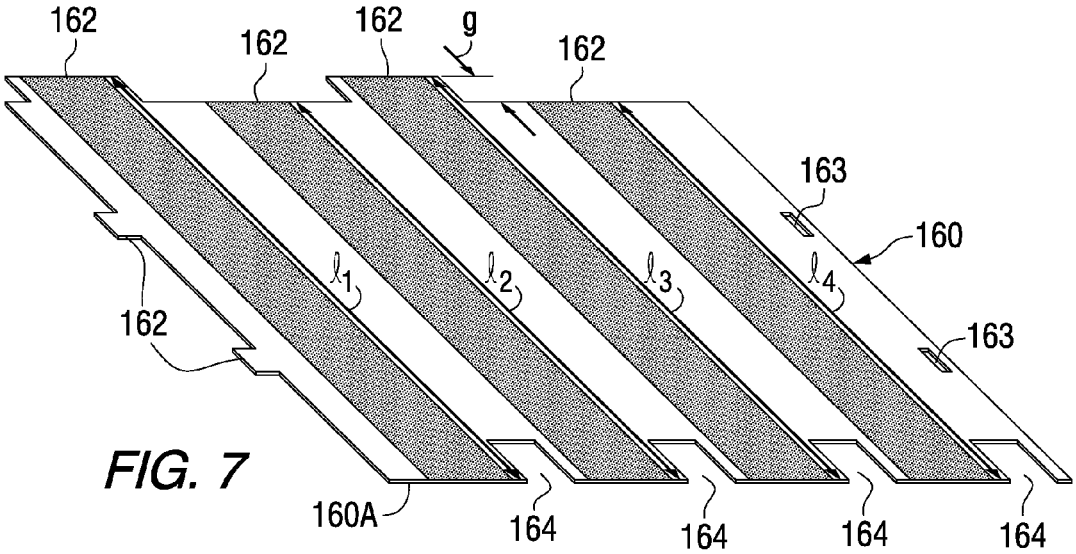
FIG. 7 illustrates a substrate for use in fabricating a QHA according to the present invention.

To retain dimensional control, and thus desired performance parameters for the QHA of the present invention, stable construction techniques are advised. FIG. 7 illustrates a dielectric substrate 160 (in one embodiment comprising a flexible material such as a flexible film) having four conductive elements 162 disposed thereon, each conductive element having a length $\ell_1$, $\ell_2$, $\ell_3$, and $\ell_4$. In a preferred embodiment, $\ell_1=\ell_3$ and $\ell_2=\ell_4$, to establish the length differential between the long filars 12 and 16 (length $\ell_1=\ell_3$) and the short filars 14 and 18 (length $\ell_2=\ell_4$). The gap distance "g" sets the length differential. If the distance "g" is too small, the fields generated from each filar pair (i.e., the first pair comprising the long filars 12 and 16 and the second pair comprising the short filars 14 and 18) partially cancel and thereby reduce the antenna gain. If the distance "g" is too large the circular signal polarization is detrimentally affected.

The substrate 160 is formed into a cylindrical shape such that the conductive elements 162 comprise the helical filars of the QHA, and is retained in the cylindrical shape using adhesive tape strips that bridge abutting edges of the substrate 160. Alternatively or in addition thereto, tabs 162 formed on the substrate 160 are captured by slots 163 formed therein to retain cylindrical dimensional control.

Figure 8:
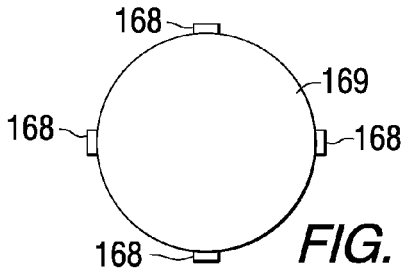
FIG. 8 illustrates certain features of an impedance matching element for use with the QHA of FIG. 5.

To further maintain dimensional control, slots 164 formed within the substrate 160 mate with corresponding tabs 168 on an impedance matching element 169 (as shown in FIG. 8) when the substrate 160 is formed into a cylinder. If the slots 164 are formed in the substrate 160 at an angle other than a right angle to an edge 160A, and the corresponding tabs 168 are formed at the same angle, the hollow cylindrical substrate 160 can be positioned over the matching element 169 and rotated into a "seated" position as the slots 164 are received by the tabs 168.

Figure 9:
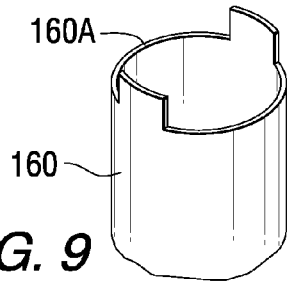
FIG. 9 illustrates an upper region of one embodiment of a QHA of the present invention.

FIG. 9 shows an upper region of the substrate 160 when formed in the cylindrical shape, illustrating the castellated upper edge 160A created by the gap distance "g."

Figure 10:
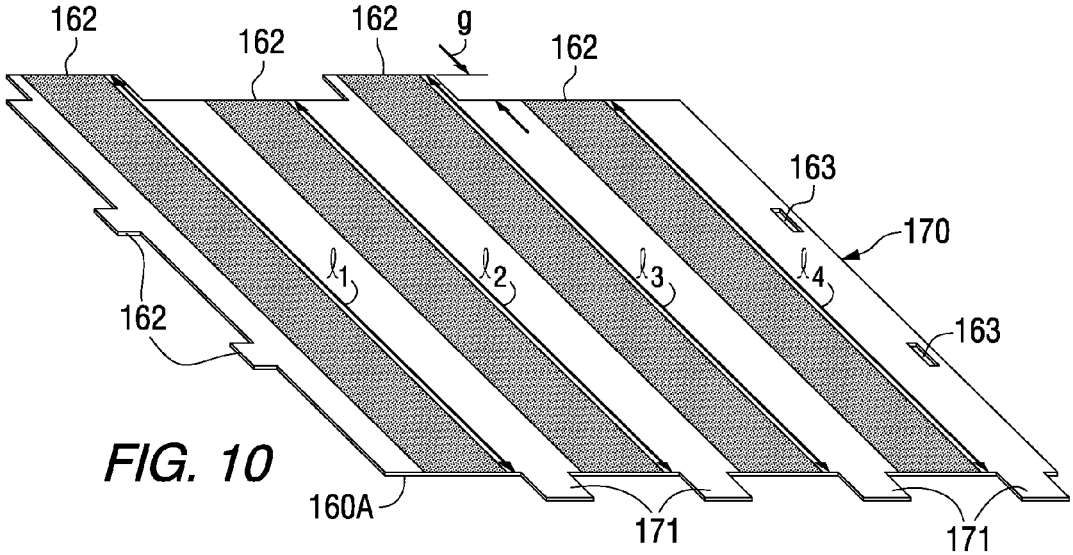
FIG. 10 illustrates another embodiment of a substrate for use with the QHA.
Figure 11:
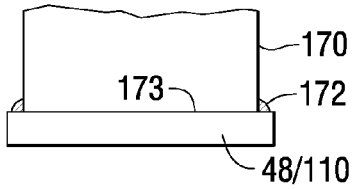
FIG. 11 illustrates a structure for connecting the impedance matching element and the QHA.

In another embodiment of FIG. 10, a substrate 170 comprises tabs 171 (in lieu of the slots 164 in the substrate 160) that are received by the openings 72A, 74A, 60A and 62A depicted in FIG. 4. FIG. 11 illustrates solder filets 172 that conductively connect each filar to its respective mounting pad 72, 74, 60 and 62 to provide positive and accurate location of the substrate 170 relative to the impedance matching element 48 or 110. In an embodiment where substrate 170 comprises the impedance matching element 48, the capacitor 57 and the inductor 59 are disposed on a surface 173.

Figure 12:
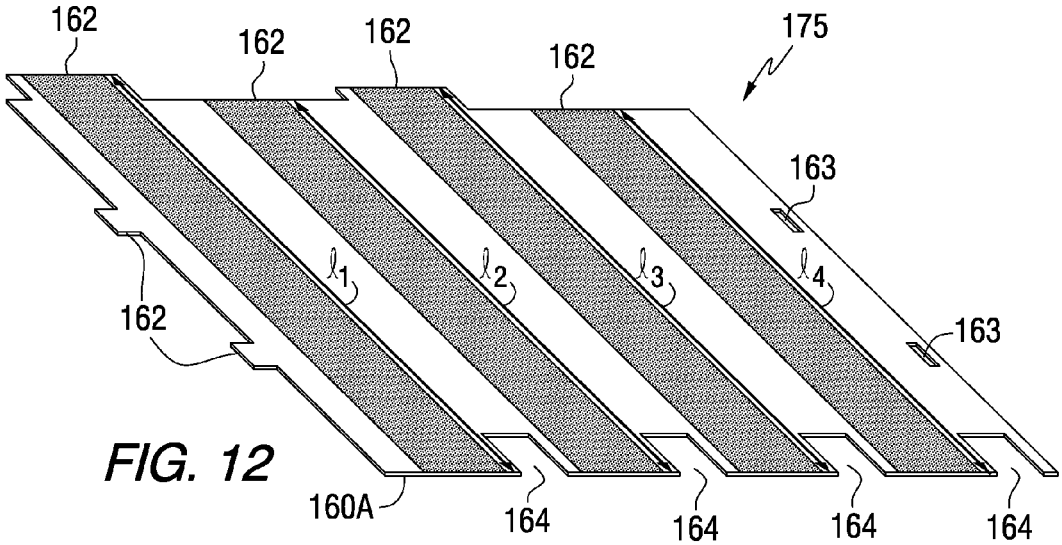
FIG. 12 illustrates another substrate embodiment for a QHA of the present invention.

In an embodiment illustrated in FIG. 12, a dielectric substrate 175 (in one embodiment comprising a flexible material such as flexible film) comprises four conductive elements 176A, 176B, 176C and 176D disposed thereon, each conductive element having a length $\ell_1$, $\ell_2$, $\ell_3$, and $\ell_4$, where $\ell_1>\ell_3>\ell_2>\ell_4$. Thus each filar comprises a different length to increase the antenna bandwidth, since cancellation of the field radiated from each filar is minimized. However, the radiation pattern provided by this embodiment may not be completely symmetric. This embodiment may be useful when the QHA size is limited and thus the bandwidth may be narrower than desired, such as for a quarter wavelength QHA.

In another embodiment, the flexible film is replaced by a rigid cylindrical structure on which conductive strips forming the helical traces are disposed, for example, by printing conductive material on outer surface of the cylindrical piece or by employing a subtractive etching process to remove certain regions from a conductive sheet formed on the outer surface, such that the remaining conductive regions form the helical traces.

To ensure the proper dimensions for the QHA, in one assembly process the substrate 160 is wound about a mandrel and retained in the cylindrical shape by the mandrel. A material of the mandrel is chosen to exhibit low loss at the antenna's operational frequencies, while providing mounting integrity and stability for the substrate 160. The mandrel dielectrically loads the antenna, which tends to lower the antenna resonant frequency. Thus the dielectric loading should be taken into consideration when determining the antenna dimensions. In another embodiment, the mandrel is used only during the assembly process and removed after completing fabrication of the QHA.

In another embodiment, apart from use of the dielectric mandrel to form the helical structure, a dielectric load can be disposed within the cylindrical interior region defined by the filars. In certain embodiments such a load provides additional physical support to the helical filars and/or tunes the resonant frequency of the antenna. It may be possible to reduce one or more physical dimensions of the QHA, employing the dielectric load to achieve the desired resonant frequency within a smaller antenna volume. However, such dielectric loading also decreases the efficiency of the antenna and decreases the antenna bandwidth.

In yet another embodiment, the resonant frequency of the QHA can be tuned by adding one or more dielectric strips (see a dielectric strip 178 in FIG. 6) to an outside surface of the QHA cylinder. Tuning after fabrication may be advantageous to overcome dimensional variances in the final antenna structure. For example, a dielectric substrate having an adhesive surface (i.e., a dielectric tape) can be affixed to the outside surface of the QHA to change the capacitance between the filars and lower the resonant frequency. A tape material width and/or length is selected to provide the desired resonant frequency shift. It has been found that the addition of the tape does not add significant losses to the antenna performance. In one embodiment the dielectric substrate comprises a polyester material.

In another embodiment, a longer bifilar loop exhibits an impedance of about 50+50j ohms and a shorter bifilar loop exhibits an impedance of about 50−50j ohms. It has been observed by the inventors that to achieve these impedance values the longer loop tends to be slightly smaller in diameter than the shorter loop. For example, if the filars have an equal diameter the long filars present an impedance of about 53+j50 and the short filars present an impedance of about 50−j 50. Reducing the diameter of the long filar lowers the long-filar impedance to about 50+j50. However, the teachings of the present invention ostensibly eliminate the need for these diameter complications as the filar lengths can be controlled to achieve the desired impedance values for matching to the driving point impedance using a impedance matching element according to the teachings of the present invention.

Figure 13:
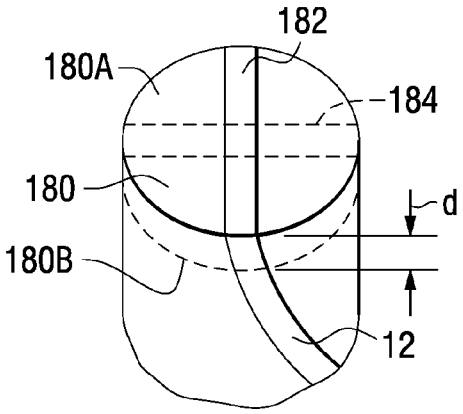
FIGS. 13 and 14 illustrate substrate structures for forming the conductive bridges of the QHA antenna of FIG. 1.

In yet another embodiment, the conductive bridges 23 and 24 are replaced with a generally circular substrate 180, having a thickness d (see FIG. 13) with conductive strips 182 and 184 disposed on opposing surfaces 180A and 180B thereof. Each end of the conductive strips 182 and 184 is electrically connected to one of the filars 12, 14, 16 and 18, providing the same electrical connectivity between filars as provided by the conductive bridges 23 and 24. Use of the substrate 180 provides additional dimensional stability to the QHA by controlling the distance between the filars at the upper end of the antenna, according to the dimensions of the substrate 180. Dimensional changes at the upper end of the antenna can lead to frequency detuning and/or gain reduction. As discussed above, the distance d is related to the length differential between the long and the short filars.

Figure 14:
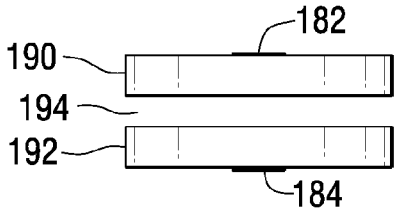

An embodiment illustrated in FIG. 14 comprises generally circular substrates 190 and 192 forming an air gap 194 therebetween. Conductive strips 182 and 184, disposed respectively on an upper surface of the substrates 190 and a lower surface of the substrate 192 electrically connect the filars 12, 14, 16 and 18 as described above. Altering the height of the air gap 194 controls the filar length differential.

Figure 15A:
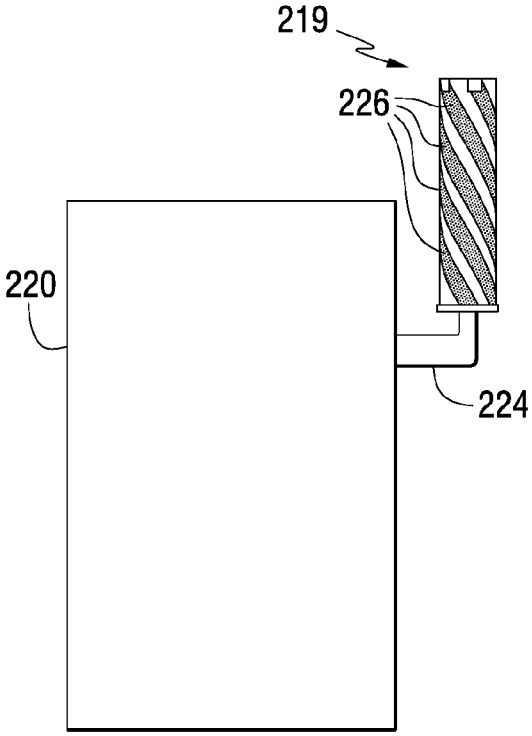
FIGS. 15A and 15B illustrate a QHA operative with a handset communications device.
Figure 15B:
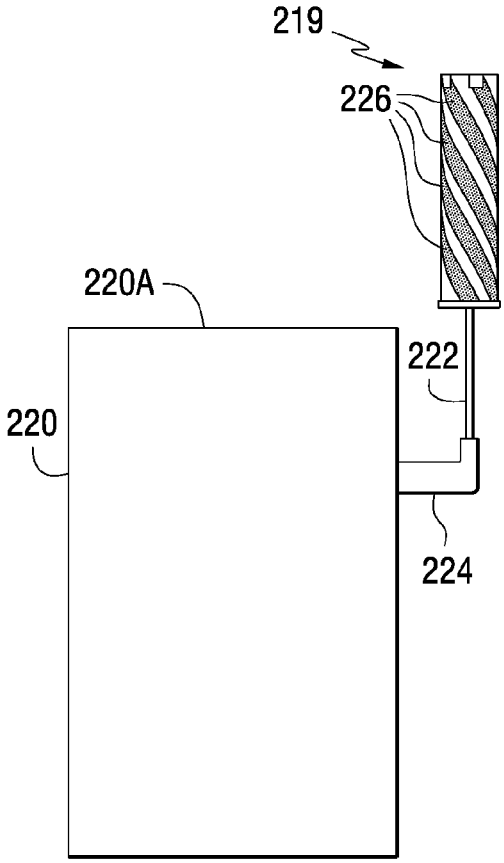

FIGS. 15A and 15B illustrate two applications for a QHA 219 constructed according to the teachings of the present invention. A communications handset or cellular phone 220 is operative with the QHA 219 for sending and receiving radio frequency signals. The embodiment of FIG. 15B comprises a conductor 222 extending from a phone-mounted connector 224 to the QHA 219. It has been found that the configuration of FIG. 15A, wherein the conductor 222 is absent and filars 226 of the QHA 219 are laterally proximate the phone 220, reduces the antenna gain due to interference between the filars 226 and the phone 220 (e.g., a printed circuit board in the phone 220). The conductor 222 of the FIG. 15B embodiment avoids this interference by extending the filars 226 above an upper surface 220A of the phone 220.

While the present invention has been described with reference to preferred embodiments, it will be understood by those skilled in the art that various changes may be made and equivalent elements may be substituted for the elements thereof without departing from the scope of the present invention. The scope of the present invention further includes any combination of the elements from the various embodiments set forth herein. In addition, modifications may be made to adapt a particular situation to the teachings of the present invention without departing from its essential scope. Therefore, it is intended that the invention not be limited to the particular embodiments disclosed, but that the invention will include all embodiments falling within the scope of the appended claims.

What is claimed is:

1. A quadrifilar helical antenna for connecting to a feed conductor having a first and a second conductive element, the antenna comprising:

a first pair of filars having a first length and comprising a first and a second filar each helically oriented between an antenna base and an antenna top;

a second pair of filars having a second length different from the first length and comprising a third and a fourth filar each helically oriented between the antenna base and the antenna top;

a substrate supporting a conductive H-shaped pattern for receiving a first end of each one of the first, second, third and fourth filars at a free end of each leg of the H-shaped conductive pattern, wherein a first region of the conductive pattern connects the first and the third filars and a second region of the conductive pattern connects the second and the fourth filars;

a first reactive element for connecting between the first region and the first conductive element;

wherein the second region is connected to the second conductive element;

a second reactive element for connecting between the first and the second conductive elements a first conductive bridge for connecting a second end of the first and the second filars proximate the antenna top; and a second conductive bridge for connecting a second end of the third and the fourth filars proximate the antenna top, wherein the first and the second conductive bridges are spaced apart by a distance d, such that a length differential between the first and the second pairs of filars is responsive to the distance d.

2. A quadrifilar helical antenna, comprising:

a first pair of filars having a first length;

a second pair of filars having a second length different from the first length; and an H-shaped impedance matching element supplying current to a first end of each of the first and the second pairs of filars from current feed points disposed symmetrically with respect to an approximate center of the H-shaped impedance matching element, wherein the H-shaped impedance matching element further comprises a reactive element for matching an antenna impedance to a source impedance, wherein the H-shaped impedance matching element further comprises a substrate having an H-shaped conductive pattern disposed thereon, and wherein a signal feed terminal is disposed at an approximate center of the H-shaped conductive pattern, wherein current is supplied from the signal feed terminal to the current feed points, and wherein the reactive element comprises at least one of a capacitor in series with a signal source and an inductor in parallel with a signal source.

* * * * *